United States Patent [19]

Fuchs

[11] Patent Number: 4,907,555

[45] Date of Patent: Mar. 13, 1990

[54] FUEL INJECTION DEVICE FOR A DIESEL ENGINE

[75] Inventor: Peter Fuchs, Adlikon, Switzerland

[73] Assignee: Nova-Werke AG, Effretikon, Switzerland

[21] Appl. No.: 207,047

[22] PCT Filed: Sep. 4, 1987

[86] PCT No.: PCT/CH87/00111

§ 371 Date: Jul. 8, 1988

§ 102(e) Date: Jul. 8, 1988

[87] PCT Pub. No.: WO88/02068

PCT Pub. Date: Mar. 24, 1988

[30] Foreign Application Priority Data

Sep. 9, 1986 [CH] Switzerland ..... 03616/86

[51] Int. Cl.[4] ..... F02M 39/00

[52] U.S. Cl. ..... 123/446; 123/447; 123/501

[58] Field of Search ..... 123/446, 447, 500, 501, 123/502

[56] References Cited

U.S. PATENT DOCUMENTS

| | | | |
|---|---|---|---|
| 4,069,800 | 1/1978 | Kanada | 123/447 |
| 4,219,154 | 8/1980 | Luscomb . | |
| 4,273,087 | 6/1981 | Goloff | 123/446 |
| 4,280,464 | 7/1981 | Kanai | 123/447 |
| 4,325,340 | 2/1982 | O'Neill | 123/447 |
| 4,425,893 | 1/1984 | McJones | 123/446 |
| 4,485,787 | 12/1984 | Kato | 123/446 |
| 4,541,385 | 9/1985 | Eheim | 123/447 |
| 4,674,448 | 6/1987 | Steiger | 123/447 |
| 4,759,330 | 7/1988 | Kato | 123/447 |

FOREIGN PATENT DOCUMENTS

| | | |
|---|---|---|
| 2496170 | 6/1982 | France . |
| 352531 | 4/1961 | Switzerland . |
| 539778 | 9/1973 | Switzerland . |

*Primary Examiner*—Carl S. Miller

*Attorney, Agent, or Firm*—Tarolli, Sundheim & Covell

[57] ABSTRACT

A fuel injector (3) has a plunger (7) with an oblique control edge (12). The plunger (7) is driven by a drive unit (20) which is acted upon by fluid pressure separate from the fuel system. The plunger (7) is rotatable around its longitudinal central axis (8) by means of a setting device (60). A control device (31) regulates the inflow and outflow of fluid pressure to a double acting piston (22) of the drive unit (20). A signal for beginning an injection cycle is given by an electric pulse generator (40) or a control camshaft (61) of the control device (31). A return piston (34) of the control device (31) is acted on by fuel pressure and is connected through a line (33) with a pump chamber (6) of the fuel injector (3). At the end of the injection cycle the control edge (12) opens a passage (14) to pressure in the pump chamber (6) and a pressure surge acts through the line (33) on the return piston (34).

9 Claims, 3 Drawing Sheets

FUEL INJECTION DEVICE FOR A DIESEL ENGINE

BACKGROUND OF THE INVENTION

1. Technical Field

The present invention relates to a fuel injection device for a diesel internal combustion engine. A pressure line connects an injection nozzle to a fuel injector The fuel injector has an injector body with at least one fuel line for the inflow and outflow of fuel. The injector has a pump chamber and a plunger. The plunger is connected with a drive assembly. The drive assembly includes an axially movable piston which is acted on by fluid pressure.

2. Description of the Prior Art

A great number of fuel injection devices for diesel internal combustion engines are known. In most of these devices, the plunger is driven by a camshaft. From Swiss Pat. No. 539,778 is known a fuel injection device in which the driving of the plunger takes place by means of a drive assembly having an axially movable piston which is acted on by fluid pressure. This device includes a delivery pump for the fuel, which is part of a device for the feeding of fuel to one or more injection nozzles. The delivery pump is connected with a reservoir and a pressure-regulating valve, which regulates the delivery pressure in the fuel conduction system. From the delivery pump, the fuel is conducted to an electro-magnetically actuated hydraulic valve, to a slide valve, to a servopiston and to the injection nozzle. The electro-magnetically actuatable hydraulic valve is connected with an electric control device, which communicates control signals for the beginning and end of the injection cycle. The slide valve is connected with the electro-magnetically actuatable hydraulic valve, and has two control edges which control the inflow of fuel to a working surface of the servopiston. The land of the slide valve is acted on by fuel at the pressure of the delivery pump and by a spring force which is less than the force exerted by the delivery pressure of the pump. The servopiston is connected directly with the plunger of the fuel injector, while the plunger conveys fuel from a pump chamber to the injection nozzle. The volume of fuel flowing into the pump chamber is determined through the pressure prevailing on the delivery pump and a restrictor located in the line.

At the beginning of the injection cycle, a control signal brings the electro-magnetically actuatable valve into a position in which the slide valve is subjected to pressure by the delivery pump. The land of the slide valve unblocks a passage from the fuel line to the working surface of the servopiston. The servopiston and, thus, the plunger are moved, and the injection process is started. At the moment desired for the end of the injection cycle, the electric control device communicates a second signal to the electro-magnetically actuatable valve. The electromagnetically actuatable valve moves to a different switch position, and the slide valve is relieved of fuel pressure from the delivery pump. The land of the slide valve is pushed by the spring force, and unblocks a passage connecting the working surface of the servopiston with a pressureless return line of the fuel system. The injection stroke is interrupted and the plunger, and the servopiston, are driven back by the delivery pressure in the fuel system. The return distance of the servopiston is determined by the volume of fuel flowing, which in turn, is predetermined by the restrictor located in the inflow. At partial capacity, the servopiston remains floating at the end of the filling stroke. That is, the servopiston is not stationary. In this inexact position of the servopiston, the fuel injection device is ready for a new injection stroke.

Fuel injection devices of the kind described make possible, through the installation of the slide valve, the use of relatively small electro-magnetically actuatable valves. But they have the disadvantage that the exact amount of the injection volume is beset with difficulties. The electric control and the whole fuel system must be very exactly adapted to each other, especially in high speed diesel engines, in order to introduce the fuel, in the right amount and at the right timing, into the combustion chamber of the diesel internal combustion engine. This tuning is difficult and involves great technical expense. Since the servopiston, within a great load range, does not start from the same stationary position during each injection cycle, the fuel amount is nevertheless very inexact. The floating servopiston cannot be exactly positioned because of leakage losses and changes in fuel viscosity cause a different degree of filling. The electric time control cannot detect and compensate for these variations. As a result, within several injection cycles, different fillings occur. The known injection device has, moreover, no backup, and the injection process cannot be carried out with failure of the electric control. The hydraulic system has a different characteristic according to the kind of fuel used, and sometimes the functionality of the hydraulic element is no longer assured

SUMMARY OF THE INVENTION

The present invention provides a fuel injection device with a plunger driven by a fluid drive, which can be used either with high speed or with low speed diesel engines, and for all kinds of fuels, in which the amount of fuel injected is not dependent on time, but is determined volumetrically. The fuel injection device also has a backup device.

According to the present invention, the plunger has at least one control edge. The plunger is connected with a pump chamber, and can be rotated around its longitudinal axis. A drive unit is connected, through a hydraulic system, to a fluid pressure source independent of the fuel system. In this hydraulic system, between fluid pressure source and drive unit, is arranged a control device with at least one main slide, which can be switched mechanically and/or electrically. The control device has at least one return piston, connected through a connection line with the pump chamber and acted upon by fuel. In the fuel lines connected with the pump chamber, at least one other control device is arranged, and connected through lines with the pump chamber.

In the present invention, the plunger is combined with a drive unit which has a drive piston acted upon by fluid. The fuel system of the fuel injector and the hydraulic system of the drive unit, are systems independent of each other and are associated with each other through a first control device. The control device can be switched mechanically and/or electrically. The control device also has a return piston which is connected with the pump chamber and acted upon by fuel. This connection line, from the pump chamber to the return piston of the control device, effects, with the control edge on the plunger, a direct acting pressure-medium system by the fuel system. According to the position of the plunger, or the control edge arranged thereon, the control device is acted on at the desired moment by fuel under high pressure, and the hydraulic system controls the drive unit. This arrangement assures the interruption of the injection cycle as soon as the plunger has travelled the desired distance, and thus an exactly determined volume of fuel is provided.

The main slide of the control device has control chambers and control edges for the opening and closing of the lines to the drive piston. The main slide cooperates, at one end, with a push rod and at the other end, with the return piston, acted on by fuel and connected with the pump chamber. At least a part of the push rod forms the core of a magnetic coil and the magnetic coil is connected with an electric pulse generator. Moreover, the push rod is part of a mechanical blocking device, and this blocking device fixes the push rod and the control edge of the main slide in a control position.

In a preferred embodiment of the present invention, the control device in the hydraulic system is connected with a control camshaft, and a cam acts on the push rod of the control device. With this arrangement, a lightweight camshaft may be used, since it need move only control elements. This is in contrast to injection devices in which the camshaft drives the plunger and must be of heavy, expensive construction. The control camshaft acts directly on the push rod of the main slide and serves as actuation of the main slide or as a back up control in case of failure of the magnetic coil. The drive piston is double-acting and the fluid pressure is conducted, to a work chamber when a surface of the piston is fully acted on, through the control device from a pump. The fluid pressure is also conducted by a fluid drive feed line continuously to an annular surface of the drive piston directly from the pressure source.

Another improvement of the fuel injection device of the present invention is obtained by a second control device which includes the upper end surface of the plunger forming a first control edge a second control edge and a fuel passage as described in the following. In the direction of the longitudinal central axis of the plunger, a channel extends on the outer circumference oblique to the longitudinal central axis with the second control edge and is connected through another channel with the pump chamber. In the injector body, at least one passage for fuel is arranged, which, when the plunger is at bottom dead center, lies above the first control edge, and when the plunger is at top dead center, lies below the second control edge. The passage for fuel in the injector body is connected through the connection line with the return piston of the first control device of the hydraulic system.

A third control device includes an inlet relief valve, and a switching piston acting on the valve shaft of the inlet relief valve. The inlet relief valve is connected through a feed line with the upper or top and of the pump chamber. The chamber of the switching piston is connected through a line with the passage in the injector body and through it with the second control device. Through this arrangement, the passage in the pump chamber may be so dimensioned that it is ideally adapted to its control function. The inflow and outflow of fuel in the pump chamber takes place through the feed line at the upper end of the pump chamber, while its dimensions, and those of the inlet relief valve are also ideally dimensioned for this inflow and outflow process.

In the operation of the fuel injection device according to the present invention, the plunger, by means of a known control device, is brought into a position dependent on the motor load, in which the control edges effect the injection of the desired amount of fuel. The start of the injection cycle is effected through the control device in the hydraulic system, by means of an electric pulse through the magnetic coil or by means of the control camshaft. The control device allows the flow of fluid drive to the drive unit which moves the plunger to put fuel under pressure in the pump chamber. At a certain pressure, the flow valve to the injection nozzle opens, and the fuel is introduced into the diesel engine. As soon as the plunger has travelled the desired distance, the pump chamber communicates through the connection line with the control device, and a pressure surge effects, through the return piston, a returning of the main slide, and in this way blocks the feeding of pressurized fluid to the working surface of the piston of the drive unit. The annular surface of the piston is still acted on, and effects an immediate moving back of the piston to the bottom dead center position and an immediate drop of pressure in the pump chamber. Because of the purely volumetric determination of the amount of fuel injected, this fuel injection device is extremely accurate, since no timing members are necessary. The start of the injection cycle can be determined exactly by known and tested means, and transmitted to the control device. Through the separation of the fuel system from the hydraulic system, the use of special hydraulic oils or other fluids is possible, which assure the long useful life desired in fuel injection devices. The combination of the oblique edge control on the plunger with a drive unit acted on by a fluid pressure gives a very high securing of operation and independence of construction. A great advantage of this fuel injector is that all the elements of construction can be arranged axially, one after another, and with this arrangement of several injectors, each is independent of the others. Heavy and expensive drive camshafts are eliminated, which is especially important in large, high-speed diesel engines. Nevertheless, back up control through the camshaft control is assured with a relatively light camshaft.

BRIEF DESCRIPTION OF THE DRAWINGS

The present invention is explained in detail below in preferred embodiments with reference to the attached drawings, in which.

DESCRIPTION OF PREFERRED EMBODIMENTS

Figure 1:
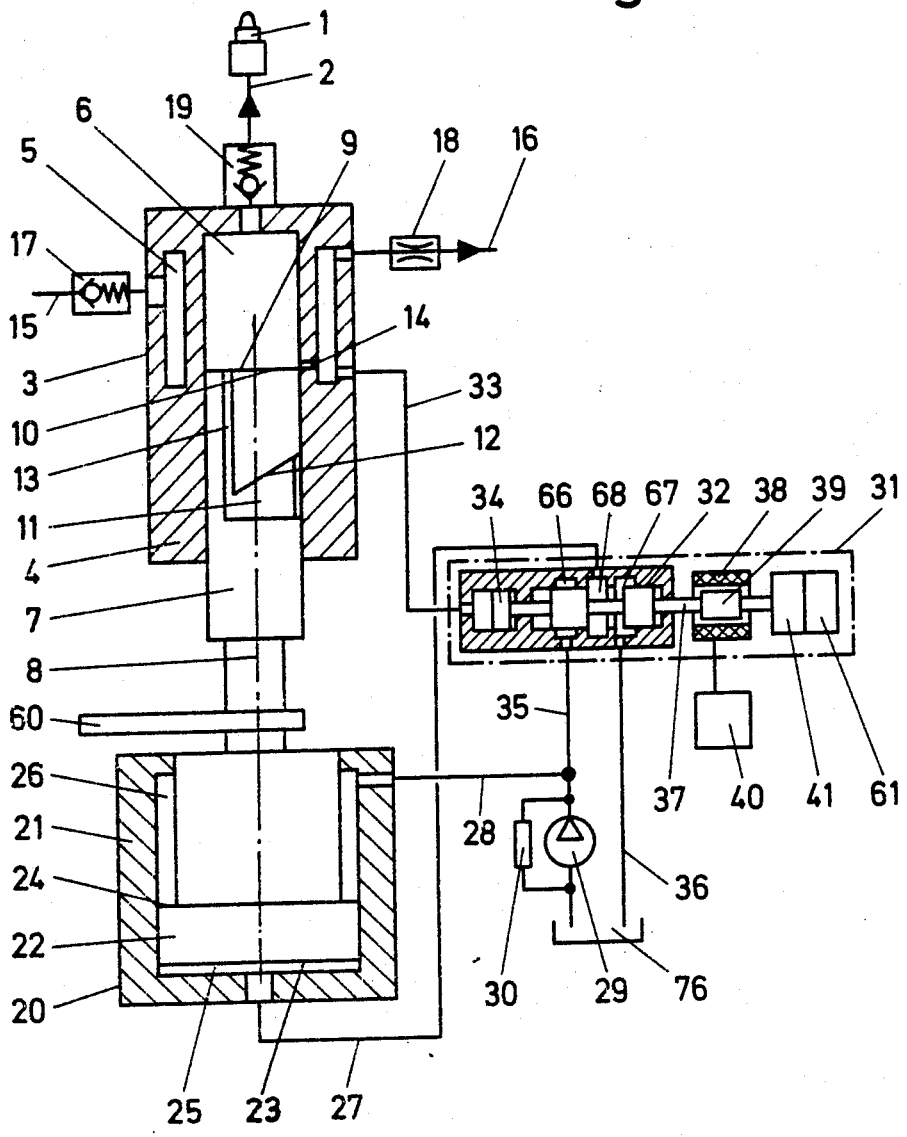
FIG. 1 is a schematic view of a fuel injection device according to one embodiment of the present invention.

A fuel injection device is illustrated in FIG. 1 and includes an injector 3, a drive unit 20 and a first control device 31. The injector 3 includes of an injector body 4 with a pump chamber 6, in which a plunger 7 is guided. The injector body 4 is provided with a fuel line which includes a feed line 15, a fuel channel 5, and an exit line 16. The fuel lines are part of a fuel system in which the fuel is carried through a delivery pump (not shown) at relatively low pressure. A check valve 17 is located in the fuel inlet line 15 to prevent the fuel in the feed line 15 from flowing back, and to prevent pressure surges occurring in the fuel channel 5 from being transmitted to the fuel inlet line 15. To reduce the pressure surges, a restrictor 18 is built into the fuel outlet line 16. From the pump chamber 6, a pressure line 2 leads to a nozzle 1. Into this pressure line 2 is connected a control valve 19, which, on reaching a certain pressure in the pump chamber 6, opens the pressure line 2 to the nozzle 1 and, on a drop of the pressure, closes the pressure line 2 again.

An upper end surface of the plunger 7 forms a first control edge 10. The plunger 7 is connected at its lower end with an axially movable drive piston 22 of the drive unit 20. The plunger 7 is not only axially movable, but by means of a setting device 60, can be rotated around its longitudinal central axis 8. The setting device 60 is known in a fuel injector with the plunger 7 having a second control edge 12. The drive unit 20 consists of a cylinder 21, the drive piston 22, a work chamber 25 and an annular chamber 26. The drive piston 22 is double acting and has an working surface 23 located in the work chamber 25 and which is axially opposite an annular surface 24 located in the annular chamber 26. The drive unit 20 is part of a fluid drive system, in which any desired known fluid may be used. In the preferred embodiment, a high-pressure hydraulic oil is used. The fluid is fed to the drive unit 20, through the lines 27, 28, by a pump 29. The control device 31 is located between the pump 29 and line 27. The control device 31 includes a main slide valve 32, a return piston 34, a magnetic coil 38 with an associated magnetic core 39, a mechanical blocking device 41 and a camshaft control 61. The fluid drive system, containing hydraulic oil, is separate from the fuel system, and the working movements of the drive piston 22 are controlled by the main slide valve 32. The main slide valve 32 is better illustrated in FIG. 3 and has two lands 62, 63 with control edges 64, 65. The land 62 is associated with a control chamber 66 and the land 63 is associated with a control chamber 67. Between the control chambers 66 and 67 is a third control chamber 68. Axially outward of the lands 62, 63 are pressure-relief chambers 69, 70 and sealing pistons 71, 72. The pressure-relief chambers 69, 70 are connected with a leakage line 88. The lands 62, 63 and the sealing pistons 71, 72 are arranged at the correct mutual distance and are connected with each other by a core 73. At one end of the main slide valve 32 is a push rod 37, which is connected with the land 63. A part of the push rod 37 forms the core 39 of the magnetic coil 38. The push rod 37 extends beyond the magnetic coil 38 and is enclosed by the mechanical blocking device 41. The mechanical blocking device 41 is connected to the camshaft control 61.

Figure 2:
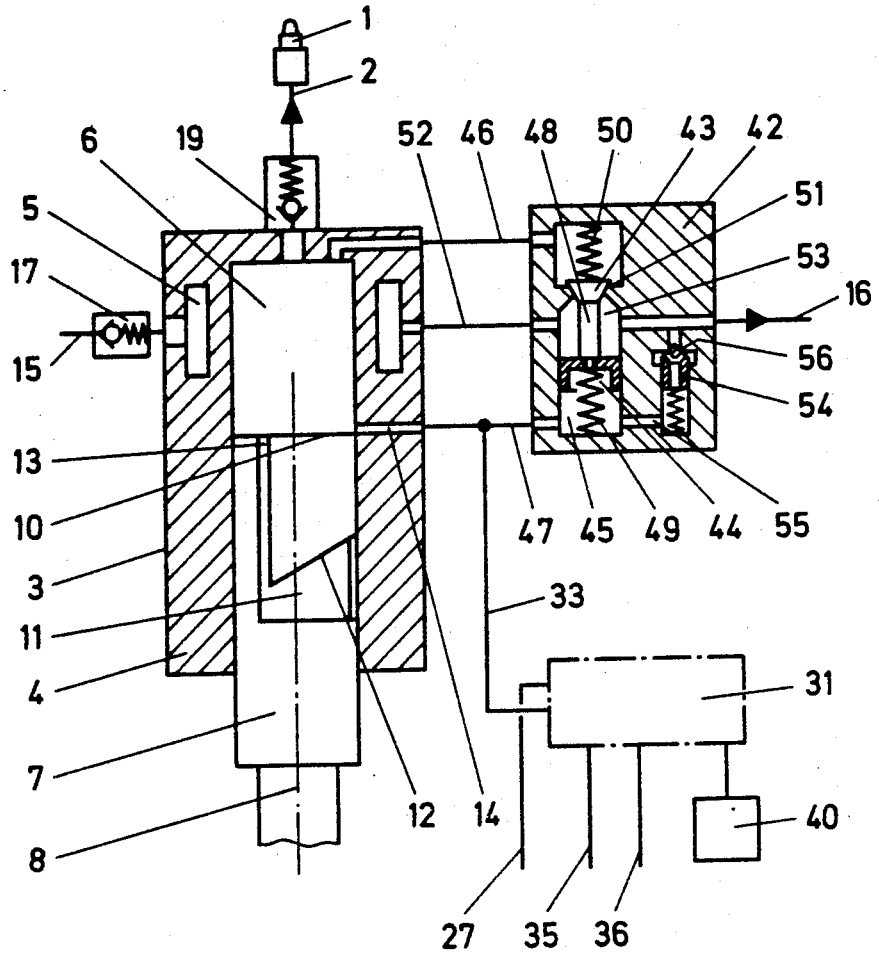
FIG. 2 is a schematic view of a fuel injection device according to another embodiment of the present invention.

On the opposite side of the main slide valve 32, the return piston 34 cooperates, through a shaft 74, with the land 62. A piston chamber 75, associated with the return piston 34, is connected, through a connection line 33, with the fuel injector 3. The connection line 33, as illustrated in FIGS. 1 and 2, communicates with a passage 14 in the injector body 4 which leads into the pump chamber 6. The passage 14 and the first control edge 10 and the second control edge 12 on the plunger 7 form a second control device.

The fluid drive system is operated by means of pump 29. A pressure regulating valve 30 controls the pressure in the fluid drive system. From the pump 29, a pressure line 35 leads to the main slide valve 32, and another line 28 leads to the annular chamber 26 of the drive unit 20. A return line 36 leads from the main slide valve 32 to a fluid reservoir 76.

In the starting position, illustrated in FIG. 1, fuel flows from the fuel feed line 15 through the fuel channel 5 and the passage 14, into the pump chamber 6. The plunger 7 and the drive piston 22 connected with the plunger 7, are in their bottom dead center position. The main slide valve 32 is biased by a spring 77 to an initial position and the land 62 closes the fluid flow between the line 35 and the line 27. With the beginning of an injection cycle, the magnetic coil 38 is excited by an electric pulse generator 40, and through the push rod 37, the main slide valve 32 is moved to the left, as viewed in FIG. 1, in the direction of the return piston 34. The land 62 opens the connection between the control chamber 66 and the control chamber 68 and, the land 63 closes the connection between the control chamber 68 and the control chamber 67. With this, fluid flows, under relatively high pressure, from the line 35 to the line 27, and thus into the working chamber 25 of the drive unit 20. The drive piston 22 moves upwardly, as viewed in FIG. 1, and forces the plunger 7 toward the control valve 19. During this axial movement of the plunger 7, the passage 14 in the injector body 4 is closed, and pressure is built up in the pump chamber 6. On reaching a certain pressure, the control valve 19 opens, and through the nozzle 1, fuel is injected into the combustion chamber of a diesel internal combustion engine. The pressure in the pump chamber 6 is communicated through a groove 13, placed on the outer circumference of the plunger 7, to a groove 11 with the control edge 12. When plunger 7 moves to a position so the control edge 12 is adjacent the passage 14, a pressure surge develops in the fuel channel 5 and in the connection line 33, which expands with sonic speed. This pressure surge is transmitted into the piston chamber 75 on the control device 31, and effects, through the return piston 34, an immediate pushing of the main slide valve 32, in the direction of the magnetic coil 38. With this, the pressure line 35 and the control chamber 66 are blocked by the land 62. The land 63 with the control edge 65 opens the connection between the control chamber 68 and the control chamber 67, and thus between line 27 and return line 36. The pressure drops, at once, in the working chamber 25 of the drive unit 20, and the pressure in the annular chamber 26 stops movement of the drive piston 22 and reverses movement of the drive piston. In the pump chamber 6, the pressure drops, and the control valve 19 closes the pressure line 2 at a predetermined pressure. As soon as the plunger 7 moves to a position so the control edge 10, formed by the upper end surface 9 of the plunger 7, is adjacent the passage 14, the pump chamber 6 is again filled with fuel, and the plunger and drive piston 22 remain in their bottom dead center position, waiting until a new injection cycle begins.

A second embodiment of the fuel injection device is illustrated in FIG. 2 and includes a third control device 42 additionally to the second control device. The plunger 7, the drive unit 20 and the first control device 31 are identical to the embodiment described above and illustrated in FIG. 1. On the injector body 4, in addition to the passage 14, a feed line 46 for fuel is located at the upper end of the pump chamber 6 into which fuel is introduced. The third control device 42 includes an inlet relief valve 43, with a relief chamber 53, a switch piston 44 and a compensating valve 54. The relief chamber 53 is connected, through a flow line 52, with the fuel channel 5 and with the fuel outlet line 16. The switch piston 44 is located in a chamber 45, as illustrated in FIG. 2, which connected through the line 47 with the passage 14. The switch piston 44 lies on a valve shaft 48, while the inlet relief valve 43 is biased to a closed position by a spring 50. Another spring 49 presses against the switch piston 44. The compensating valve 54 is designed as a check valve, and is connected through a bore 55 with the chamber 45. When a lower pressure is in the chamber 45 than in the line 16, the valve 54 moves from its valve seat 56, and opens so fuel flows back into the chamber 45 and the lines 47 and 33.

With the beginning of the work stroke of the plunger 7, the control edge 10 closes the passage 14. Pressure increase in the pump chamber 6 and the valve 43 presses against its valve seat 51. As soon as the control edge 12 moves to a position adjacent the passage 14, the pressure surge expands through the line 33 to the return piston 34 in the control device 31, and through the line 47 into the chamber 45, and, thus, to the switch piston 44. As described above in connection with FIG. 1, the movement of the drive piston 22 is interrupted through the control device 31. The pressure surge, on the switch piston 44 effects, through the valve shaft 48, an immediate opening of the inlet relief valve 43, whereby the pressure in the pump chamber 6 is relieved through the line 46 into the relief chamber 53 and into the fuel return line 16. This pressure drop in the pump chamber 6 has the result that the control valve 19, at once, and at an exactly determined moment, closes and prevents the backflow of fuel to the nozzle 1.

Figure 3:
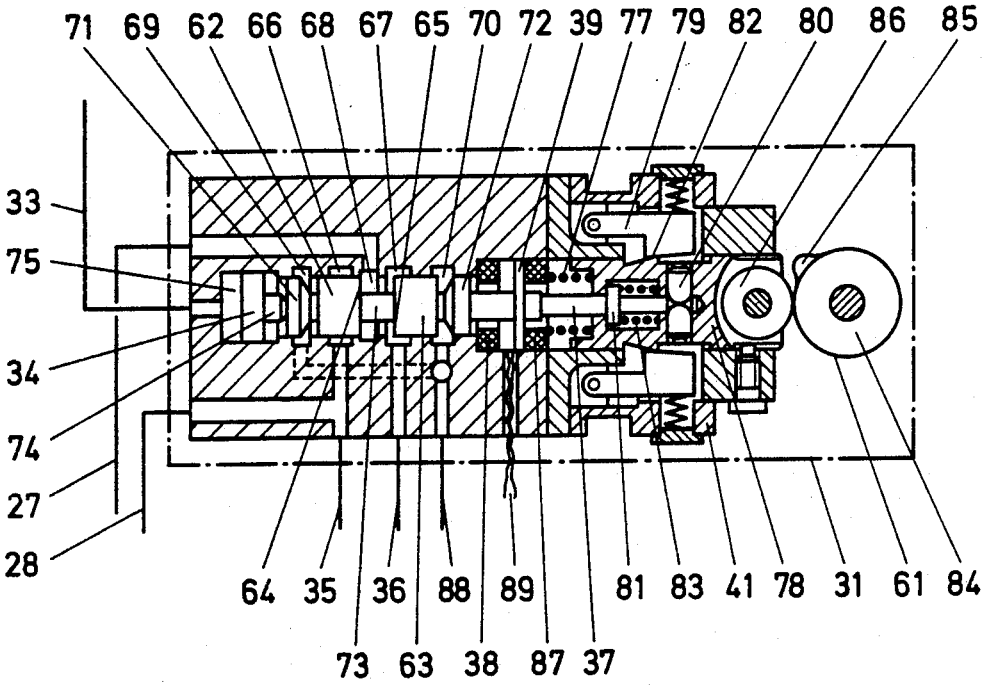
FIG. 3 is a cross-sectional view of a control device used in the fuel injection devices of FIGS. 1 and 2.

FIG. 3 illustrates, in addition to the main slide valve 32, the mechanical blocking device 41 and the camshaft control 61. The mechanical blocking device 41 consists mainly of a blocking body 78, catches 79 and release bolts 80. The push rod 37 extends into the blocking body 78, and has in this region a shoulder 81. When the push rod 37 is pushed to the left by the magnetic coil 38, the shoulder 81 carries with it the blocking body 78, and the spring biased catches 79 engage in the cams 82. In this way, the feeding of current to the magnetic coil 38 can be interrupted, and there is no danger of overloading and overheating. The returning of the push rod 37 takes place at the end of the injection cycle, through the return piston 34 being acted on by the injection pressure. With this, the push rod 37 is moved to the right, against the force of the spring 83, and the release bolts 80 are driven outwardly. The release bolts 80 lift the blocking catches 79 and free the cams 82 on the blocking body 78. The spring 77 now presses the blocking body 78 back into its initial position.

In the preferred embodiments, in addition to the magnetic coil 38 of the control devices 31, there is a camshaft control 61. This consists of a camshaft 84 with a cam 85 and a follower 86 attached to the blocking body 78. The camshaft control 61 is driven by a drive, not shown, which is connected with the crankshaft. Upon failure of the electric pulse generator 40 or the magnetic coil 38, or with a failure of current, the cam 85 drives the blocking body 78, through the follower 86 and, thus, pushes the push rod 37 to the left at the beginning of the injection cycle. The movement of the blocking body 78 and of the push rod 37 requires a relatively small force, and the camshaft 61 and the follower 86 can therefore be light, and built without great kinematic expense. The returning of the push rod 37 at the end of the injection cycle, takes place in the same way as described above. Beside the magnetic coil 38, there is arranged a second magnetic coil 87. Both coils receive, through the electric wires 89, electric pulses from the electric pulse generator 40. By actuating the magnetic coil 87 with an electric pulse, the push rod 37 can be pushed to the right, and thus the injection cycle interrupted prematurely. This allows an emergency stop of the fuel injection device, since by this movement of the main slide valve 32, the pressure acting on the drive piston 22 of the drive unit 20 is interrupted and the piston 22 moves toward its bottom dead center position.

What is claimed:

1. A fuel injection device for a diesel engine, the fuel injection device having an injection nozzle connected through a pressure line to a fuel injector, the fuel injector having a body with at least one fuel line for the inflow and outflow of fuel, a pump chamber and a plunger, the plunger being connected with a drive unit acted on by fluid pressure to drive the plunger, with the distinction that the plunger (7) is rotatable around its longitudinal central axis (8) and has a groove (11) in its surface fluidly connected with the pump chamber (6), said groove (11) having a first helical control edge (12), a pressure source (29) independent of the fuel supply is fluidly connected to the drive unit (20), a first control device (31) is fluidly connected between said pressure source (29) and the drive unit (20), said first control device (31) being actuatable mechanically and electrically and having at least one main slide valve (32) fluidly separated of the fuel system, said first control device (31) being connected to the pump chamber (6) through a connection line (33) and by return piston (34) acted on by the injection pressure of the fuel, and at least one further control device located in a fuel line (15, 5, 16) is fluidly connected with the pump chamber (6).

2. The fuel injection device according to claim 1 further including a second control device, said second control device including an end surface (9) forming a second control edge (10) on the plunger (7) and said groove (11), said first control edge (12) extending oblique to the longitudinal axis (8) of the plunger (7), said groove (11) being fluidly connected through a channel (13) with the pump chamber (6) and further including a passage (14) for fuel located in the injector body (4) being connected with the fuel line (5, 16), said passage (14) being fluidly connected through a connection line (33) with the return piston (34) in said first control device (31), said passage (14) being located in said injector body (4) so that it is above said second control edge (10) of the plunger (7) and so that fuel flow between the pump chamber (6) and said passage (14) is unrestricted by the plunger (7) when the plunger (7) is at its bottom dead center position, said first control edge (12) of the plunger (7) being positioned above said passage (14) when the plunger (7) is at its top dead center position so that the plunger (7) again does not restrict fuel flow between the pump chamber (6) and said passage (14).

3. A fuel injection device for a diesel engine, the fuel injection device having an injection nozzle connected through a pressure line to a fuel injector, the fuel injector having a body with at least one fuel line for the inflow and outflow of fuel, a pump chamber and a plunger, the plunger being connected with a drive unit acted on by fluid pressure to drive the plunger, with the distinction that the plunger (7) is rotatable around its longitudinal central axis (8) and has a groove (11) in its surface fluidly connected with the pump chamber (6), said groove (11) having a first helical control edge (12), a pressure source (29) independent of the fuel supply is fluidly connected to the drive unit (20), a first control device (31) is fluidly connected between said pressure source (29) and the drive unit (20), said first control device (31) being actuatable mechanically and electrically and having at least one main slide valve (32) fluidly separated of the fuel system, said first control device (31) being connected to the pump chamber (6) through a connection line (33) and by return piston (34) acted on by the injection pressure of the fuel, and at least one further control device located in a fuel line (15, 5, 16) is fluidly connected with the pump chamber (6), said main slide valve (32) including lands (62, 63) for controlling the opening and closing of fluid communication lines (27, 35) to the drive unit (20) and further including a push rod (37) connected at one end with said main slide valve (32) and at another end with said return piston (34).

4. A fuel injection device for a diesel engine, the fuel injection device having an injection nozzle connected through a pressure line to a fuel injector, the fuel injector having a body with at least one fuel line for the inflow and outflow of fuel, a pump chamber and a plunger, the plunger being connected with a drive unit acted on by fluid pressure to drive the plunger, with the distinction that the plunger (7) is rotatable around its longitudinal central axis (8) and has a groove (11) in its surface fluidly connected with the pump chamber (6), said groove (11) having a first helical control edge (12), a pressure source (29) independent of the fuel supply is fluidly connected to the drive unit (20), a first control device (31) is fluidly connected between said pressure source (29) and the drive unit (20), said first control device (31) being actuatable mechanically and electrically and having at least one main slide valve (32) fluidly separated of the fuel systems, said first control device (31) being connected to the pump chamber (6) through a connection line (33) and by return piston (34) acted on by the injection pressure of the fuel, at least one further control device located in a fuel line (15, 5, 16) is fluidly connected with the pump chamber (6), a double acting drive piston (22) has a work surface (23) located in a working chamber (25), a fluid pressure line (27) connects the pressure source (29) to said work chamber (25) through said control device (31), and a fluid pressure line (28) connects an annular chamber (26) to the pressure source (29) for continuously applying fluid pressure to an annular surface (24) of said piston (22).

5. A fuel injection device for a diesel engine, the fuel injection device having an injection nozzle connected through a pressure line to a fuel injector, the fuel injector having a body with at least one fuel line for the inflow and outflow of fuel, a pump chamber and a plunger, the plunger being connected with a drive unit acted on by fluid pressure to drive the plunger, with the distinction that the plunger (7) is rotatable around its longitudinal central axis (8) and has a groove (11) in its surface fluidly connected with the pump chamber (6), said groove (11) having a first helical control edge (12), a pressure source (29) independent of the fuel supply is fluidly connected to the drive unit (20), a first control device (31) is fluidly connected between said pressure source (29) and the drive unit (20), said first control device (31) being actuatable mechanically and electrically and having at least one main slide valve (32) fluidly separated of the fuel system, said first control device (31) being connected to the pump chamber (6) through a connection line (33) and by return piston (34) acted on by the injection pressure of the fuel, at least one further control device located in a fuel line (15, 5, 16) is fluidly connected with the pump chamber (6), a third control device (42) is located in the fuel line (15, 5, 16), said third control device (42) having an inlet relief valve (43) and a switch piston (44) acting on a valve shaft (48) of said inlet relief valve (43), said inlet relief valve (43) being fluidly connected through a feed line (46) with the upper end of the pump chamber (6), said switch piston (44) being located in a piston chamber (45) fluidly connected through a line (47) with said passage (14) in the injector body (4) and thereby with said first control device (31).

6. A fuel injection device for use with a diesel engine comprising:

a fuel injector including an injector body defining a pump chamber and having at least one fuel line for the inflow of fuel from a fuel source to said pump chamber and the outflow of fuel from said pump chamber, and a plunger rotatable about its longitudinal central axis and axially movable in said pump chamber and having in its surface a groove with a first helical control edge;

an injector nozzle connected through a pressure line to said pump chamber and allowing fuel under pressure in said pump chamber to flow from said pump chamber through said pressure line to the diesel engine when the fluid pressure in said pump chamber is at or above a predetermined fluid pressure;

a pressure source independent of the fuel source for providing a source of fluid pressure;

a drive unit connected with said plunger for driving said plunger axially within said pump chamber in response to fluid pressure from said pressure source; and an actuatable first control device fluidly connected between said pressure source and said drive unit, said first control device being actuatable mechanically and electrically, said first control device including at least one main slide valve for, when in an open position, allowing fluid flow from said pressure source to said drive unit to axially move said plunger within said pump chamber and to thereby put fuel under pressure in said pump chamber, said main slide valve having a return piston which is acted on by the fluid pressure in said pump chamber when said plunger has axially moved a predetermined distance within said pump chamber, said return piston moving said main slide valve to a closed position to interrupt fluid flow from said pressure source to said drive unit when said return piston is acted on by the fluid pressure in said pump chamber.

7. The fuel injection device according to claim 3 further including an electric pulse generator and a core (39) of a magnetic coil (38) formed on at least a part of said push rod (37), said magnetic coil (38) being operatively connected with said electric pulse generator (40).

8. The fuel injection device according to claim 3 further including a mechanical blocking device (41) for holding said push rod (37) in a predetermined axial position.

9. The fuel injection device according to claim 3 further including a camshaft control (61) having a camshaft (84) for moving said push rod (37).

* * * * *